United States Patent [19]

Kozyrski et al.

[11] Patent Number: 4,871,156

[45] Date of Patent: Oct. 3, 1989

[54] MAT BEVEL CUTTING MACHINE

[75] Inventors: Vincent T. Kozyrski, Plainville; Alan R. Peters, Milford, both of Conn.

[73] Assignee: The Fletcher-Terry Company, Farmington, Conn.

[21] Appl. No.: 267,502

[22] Filed: Nov. 4, 1988

Related U.S. Application Data

[62] Division of Ser. No. 13,578, Feb. 11, 1987.

[51] Int. Cl.[4] ..... B26D 5/08; B26D 7/02; B26D 7/26

[52] U.S. Cl. ..... 269/303; 269/319; 269/1; 83/455; 83/468; 83/614; 83/829; 83/581

[58] Field of Search ..... 269/303, 319, 1; 83/468, 455, 581, 614, 821, 829, 635, 564

[56] References Cited

U.S. PATENT DOCUMENTS

| | | | |
|---|---|---|---|
| 491,307 | 2/1893 | Gaylord . | |
| 570,180 | 10/1896 | McCall . | |
| 611,238 | 9/1898 | Drinkaus . | |
| 3,130,622 | 4/1964 | Eno | 83/529 |
| 3,213,736 | 10/1965 | Keeton | 83/455 |
| 3,463,041 | 8/1969 | Shapiro et al. | 83/564 |
| 3,527,131 | 9/1970 | Ellerin | 83/522 |
| 3,779,119 | 12/1973 | Broides | 83/581 |
| 3,903,767 | 9/1975 | Kupersmith | 83/7 |
| 3,996,827 | 12/1976 | Logan | 83/455 |
| 4,036,486 | 7/1977 | Molpus | 269/303 |
| 4,413,542 | 11/1983 | Rempel | 83/455 |
| 4,440,055 | 4/1984 | Gelfand | 83/529 |

OTHER PUBLICATIONS

Keencut Arrow Flyer.

*Primary Examiner*—Donald R. Schran
*Attorney, Agent, or Firm*—Ira S. Dorman

[57] ABSTRACT

A mat cutting machine utilizes a trolley which runs smoothly and accurately along a shaft mounted upon the clamping bar assembly. Means is provided for precisely adjusting the relationship between the bevel cutting blade and the edge of the clamping bar, and the blades are held by magazines which permit ready interchangeability and facile adjustment of the amount of blade protrusion so as to enable the cutting depth to be altered with considerable ease. The base of the machine includes means for accurately positioning the workpiece, and for readily controlling the travel of the trolley, to afford high volume production capability.

5 Claims, 8 Drawing Sheets

FIG. 6
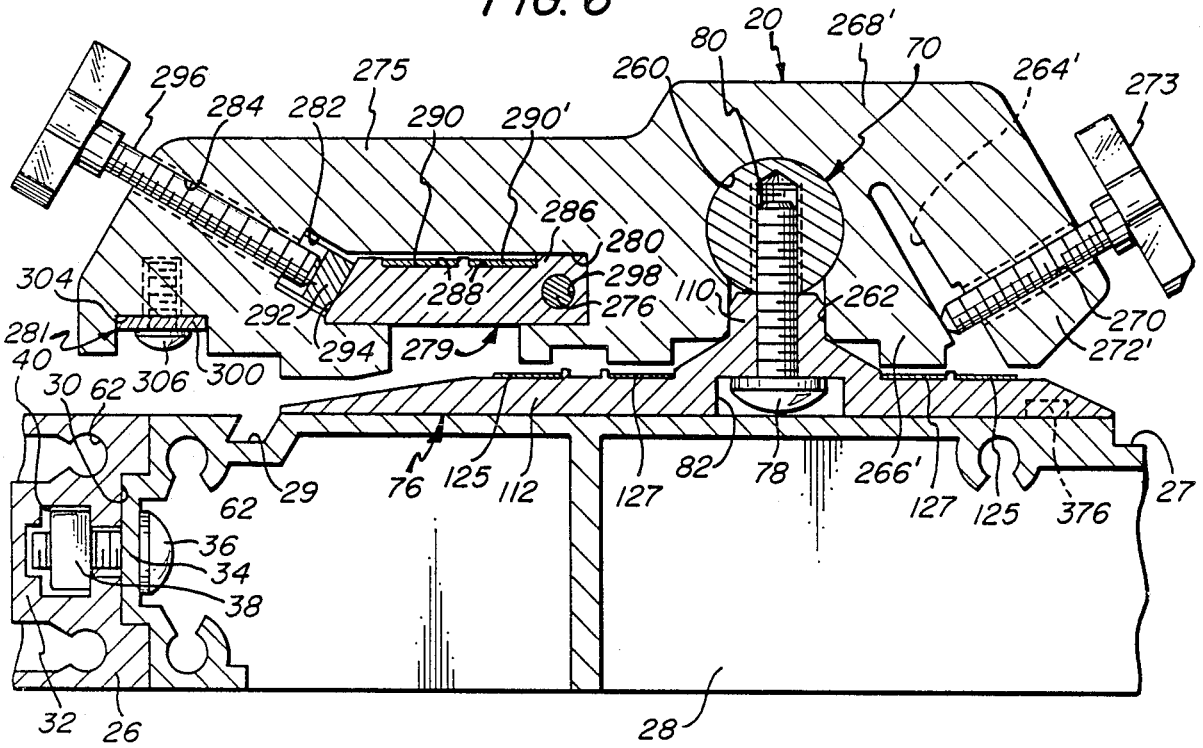
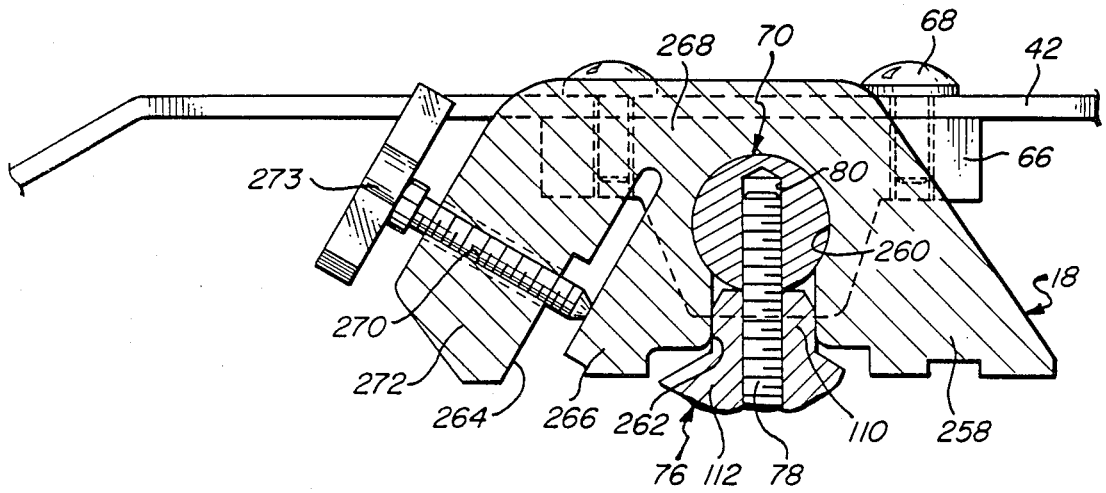
FIG. 7

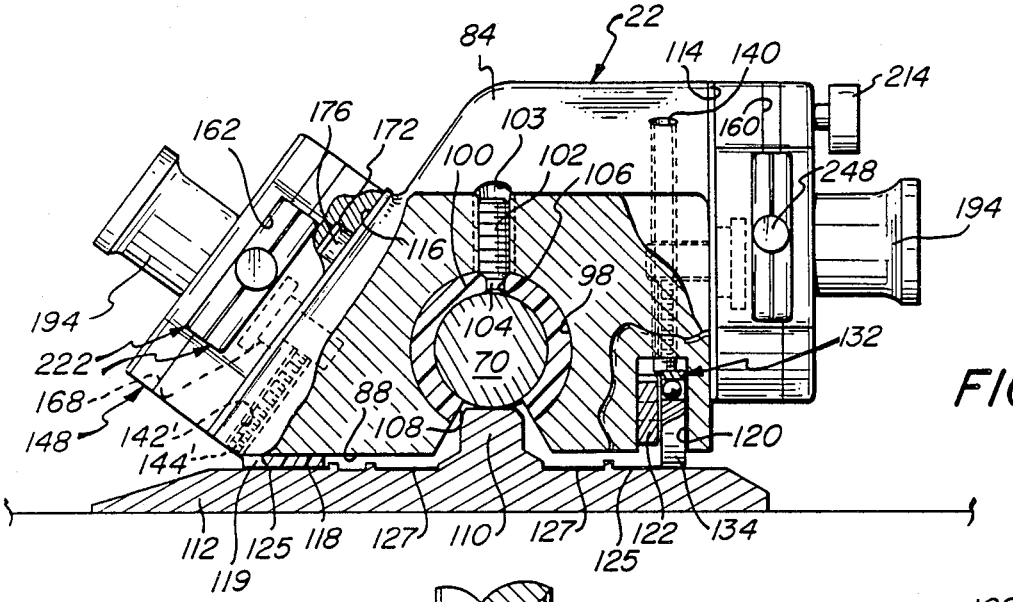
FIG. 8
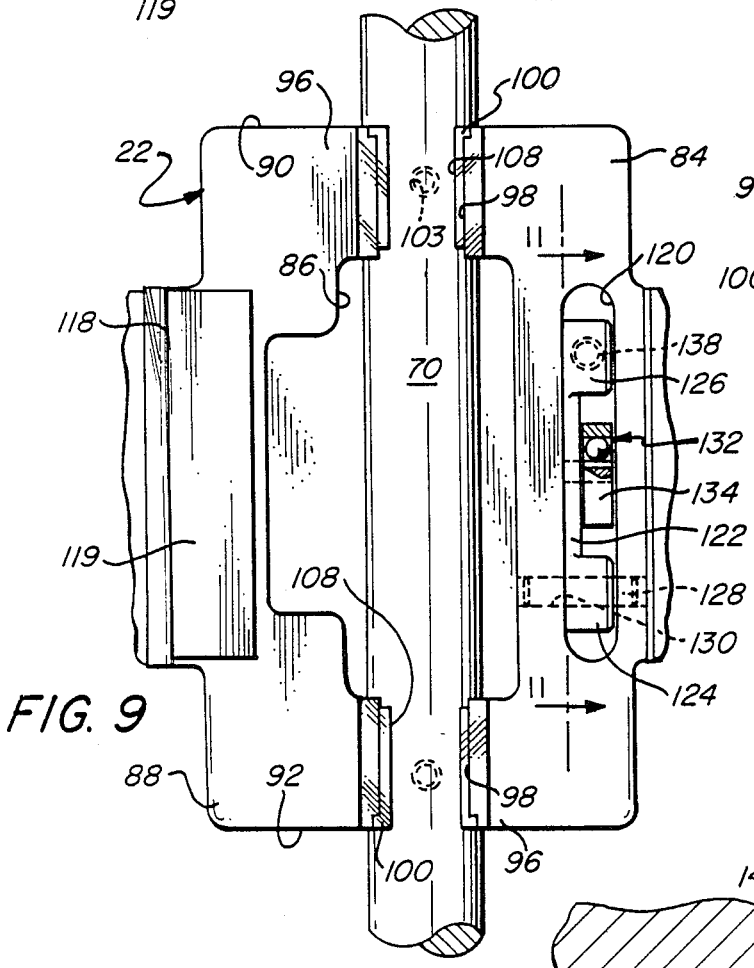
FIG. 9
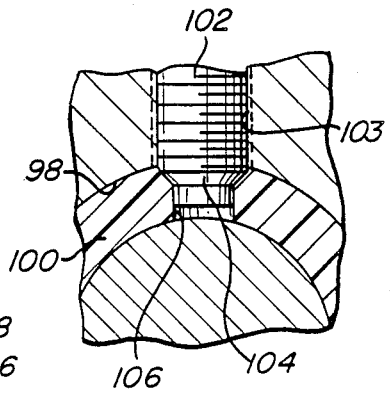
FIG. 10
FIG. 11
ROTATE 90°
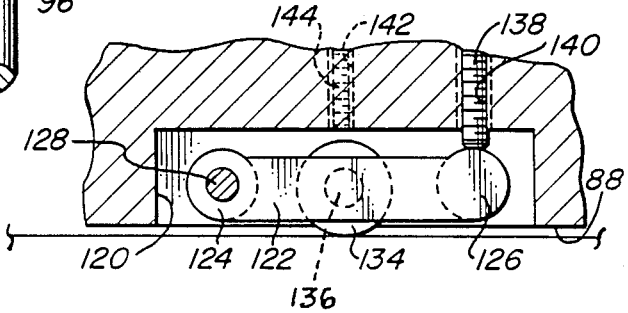

MAT BEVEL CUTTING MACHINE

This is a division of co-pending application Ser. No. 013,578, filed on Feb. 11, 1987.

BACKGROUND OF THE INVENTION

Hand-operated machines for cutting mat board used in picture framing are well known in the art. Generally, such machines include a base, to which may be mounted a clamping bar for holding the mat board in position thereupon during the cutting operation. In some forms, the clamping bar will have a shaft or rail supported upon it, which in turn serves to guide a cutting head or trolley across the workpiece. Since, in the usual case, the sight opening for the framed picture will be defined by beveled edges, the cutting heads have often been provided with two blade holders, one disposed to position a blade to cut perpendicularly with respect to the supporting surface, the other being disposed to position a second blade at an acute angle (typically, about 55 degrees) thereto.

The patent art with respect to machines and devices for cutting mat board and similar workpieces is quite voluminous. A fair representation thereof is believed to be constituted by the following U.S. Pat. Nos. Smith 228,686; Gaylord 491,307; Wheeler 513,851; McCall 570,180; Drinkaus 611,238; Gaffney 1,235,459; Williams 1,250,538; Buckingham 1,529,340; Simpson 1,897,534; Matthews 2,013,893; Smith 2,065,761; Tourneau 2,342,946; Carpenter 2,413,544; Schlitters 2,449,327; Pulsifer 2,581,602; Zelewsky 3,095,247; Eno 3,130,622; Shapiro 3,463,041; Ellerin 3,527,131; Hearns 3,543,627; Rogers 3,628,412; Decker 3,702,716; Rosetti 3,712,166; McBride 3,768,357; Martin 3,897,706; Kupersmith 3,903,767; Chaffin 3,953,086; Schwartz 3,964,360; Stowe 3,973,459; Logan 3,996,827; Jones 4,022,095; Meshulam 4,064,626; Ward 4,096,631; Larson 4,202,233; Rempel 4,413,542; Gelfand 4,440,055; Davis 4,503,612; Heathe 4,518,205; Bruns 4,570,516; and Sobel 4,590,834. Despite the activity indicated by the foregoing, the need remains for a high quality mat cutting machine which is capable of smooth and comfortable operation, to reliably and repeatedly produce cuts that are precisely rectilinear.

Accordingly, it is the broad object of the present invention to provide a novel mat cutting machine that is capable of producing both perpendicular and also bevel cuts in mat board, with a high degree of accuracy and without substantial deviation from strict rectilinearity.

It is a related object of the invention to provide such a machine wherein the cutting head is rigidly supported, and which yet affords smooth, comfortable, and facile operation, with ready adjustability to achieve ideal positioning of the bevel-side blade.

A further object of the invention is provide a machine having the foregoing features and advantages, in which the mat board can readily be positioned quickly and accurately so as to permit high volume production capability, which machine is also relatively economical and facile to manufacture and is attractive from an aesthetic standpoint.

SUMMARY OF THE INVENTION

It has now been found that certain of the foregoing and related object of the invention are readily attained by the provision of a head assembly for a mat cutting machine, comprising a body having a bottom surface with at least one planar area thereon, a rectilinear channel extending from end-to-end through the body and opening on the bottom surface along the entire length thereof, a surface portion along one side of the body substantially perpendicular to the planar area of the bottom surface, and a surface portion along the opposite side of the body disposed at an acute angle thereto. Both of the surface portions extend substantially parallel to the axis of the channel, and the planar area lies between the opening of the channel and the "opposite" side of the body. The head assembly also includes a thin web of a low-friction synthetic resinous material disposed over the planar surface area, and a wheel subassembly including a wheel and means for mounting it on the body. The wheel rotates about an axis perpendicular to the axis of the channel, and has a rim portion that extends beyond the bottom surface of the body between the channel opening and the "one" side thereof; the mounting means is adapted to permit variation of the amount of such wheel rim portion extension.

In preferred embodiments, the wheel mounting means will comprise a pivot arm pivotably supported upon the body and mounting the wheel at a location spaced from the axis of pivotable support. The assembly will, in those instances, additionally include an adjustment element in effective engagement with the pivot arm, for varying its angular orientation about the support axis and thereby the amount of rim portion extension beyond the bottom surface of the body. Most desirably, the wheel will comprise a bearing assembly including an inner race, an outer race providing the rim portion, and rolling bearings therebetween.

The planar area on the bottom surface will normally extend along the length of the body and will be substantially contiguous with the "opposite" side surface portion, the web being a strip disposed along and closely adjacent to the edge of the body that lies between the planar area and the same side surface portion. A length of adhesive tape applied to the bottom surface of the body will advantageously provide the low friction web, and the synthetic resin thereof will suitably be polyethylene.

In addition, the head assembly will preferably include a pair of bushing elements fabricated from a low-friction synthetic resinous bearing material and disposed within the body channel adjacent its opposite ends. In such an embodiment, the body may have means overlying the bushing elements to permit adjustment of clearances. Most desirably, the bushing elements will be of ring-like structure forming less than a complete circle, and the overlying means will be adapted to apply upward force upon the body to effect tightening against a mounting rail.

Other objects of the invention are attained by the provision of a trolley for a mat cutting machine, including a head assembly having the features hereinabove described. In addition, it will have a blade carrier mounted on the body against a side surface portion for pivotable movement about an axis normal thereto, and the carrier will in turn have open-ended slot-defining structure thereon adapted to disengageably support an inserted blade magazine. The magazine will in turn be adapted to hold a cutting blade within a cavity thereof so that a sharpened end portion of the blade extends from one end. The magazine will be slidably seated within the slot of the carrier with its "one" end inserted first and in such position that the end portion of the blade will protrude. Cooperating means on the carrier and magazine serves to prevent relative movement, in the direction of insertion, beyond the position of desired protrusion, while however permitting such movement in the opposite direction to enable ready removal of the magazine.

The trolley will preferably include clamping means for exerting force upon the magazine when it is in the slot, and the magazine will have a wall portion, disposed over its cavity, which is sufficiently deflectable to transmit applied force to a blade therewithin. The clamping means will be so positioned as to act upon the magazine wall portion, and will serve not only to retain the magazine within the slot, but also to secure the blade.

Normally, the clamping means will comprise a component that is threadably engaged within the carrier, and that extends into the slot for direct contact with the magazine. The magazine may be comprised of a matched pair of superimposed plates affixed to one another and cooperatively defining a planar cavity between them, and it will desirably include an abutment component spaced to the opposite side of the cavity from the "one" end and adjustably positionable therealong, as previously described.

BRIEF DESCRIPTION OF THE DRAWINGS

FIG. 6 is a fragmentary sectional view, taken along line 6—6 of FIG. 1 and drawn to a greatly enlarged scale, showing the upper production stop assembly and associated parts of the machine;

FIG. 7 is an enlarged scale fragmentary sectional view, taken along line 7—7 of FIG. 1, showing the lower production stop assembly and associated machine parts;

FIG. 8 is an elevational view, to the same scale, of the trolley mounted upon the clamping bar of the machine, taken in partial section along line 8—8 of FIG. 1;

FIG. 9 is a fragmentary bottom view of the trolley and associated of the supporting rail, a portion of the roller bearing mounted, in the head assembly thereof being broken away to show internal structure;

FIG. 10 is an enlarged fragmentary view of a small section of the trolley as depicted in FIG. 8;

FIG. 11 is a fragmentary sectional view taken along line 11—11 of FIG. 9, and rotated as indicated;

DETAILED DESCRIPTION OF THE ILLUSTRATED EMBODIMENTS

Figure 1:
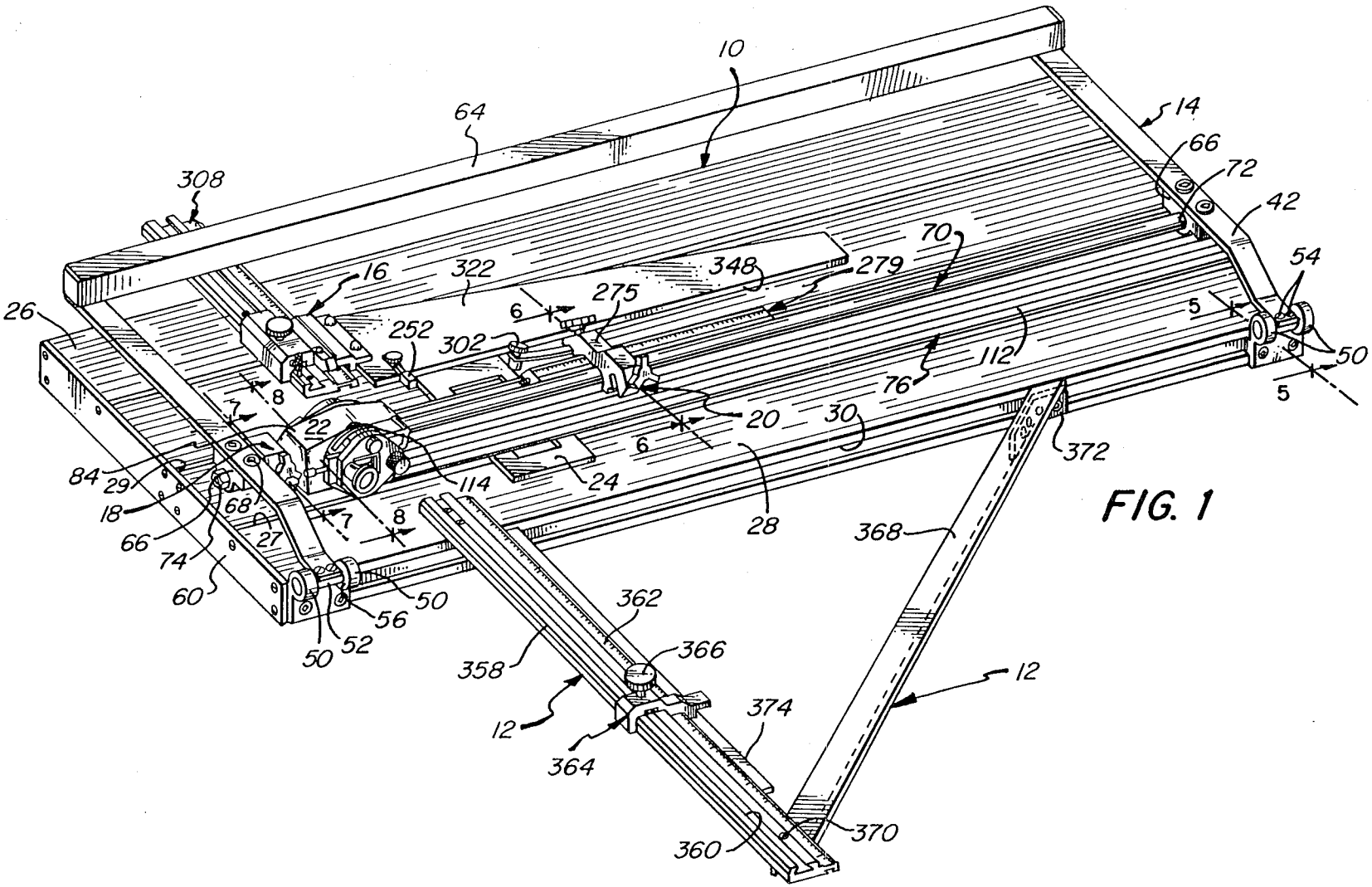
FIG. 1 is a perspective view of a machine embodying the present invention, with a piece of mat board to be cut positioned therein.

Turning now in detail to FIGS. 1–13 of the appended drawings, therein illustrated is a mat cutting machine embodying the present invention. It consists of a base, generally designated by the numeral 10, a sizing frame attachment, generally designated by the numeral 12, a handle assembly, generally designated by the numeral 14, a squaring guide assembly, including a slider subassembly generally designated by the numeral 16, a lower production stop, generally designated by the numeral 18, an upper production stop, generally designated by the numeral 20, a trolley, including a head assembly generally designated by the numeral 22, and a piece of mat board 24.

Figure 5:
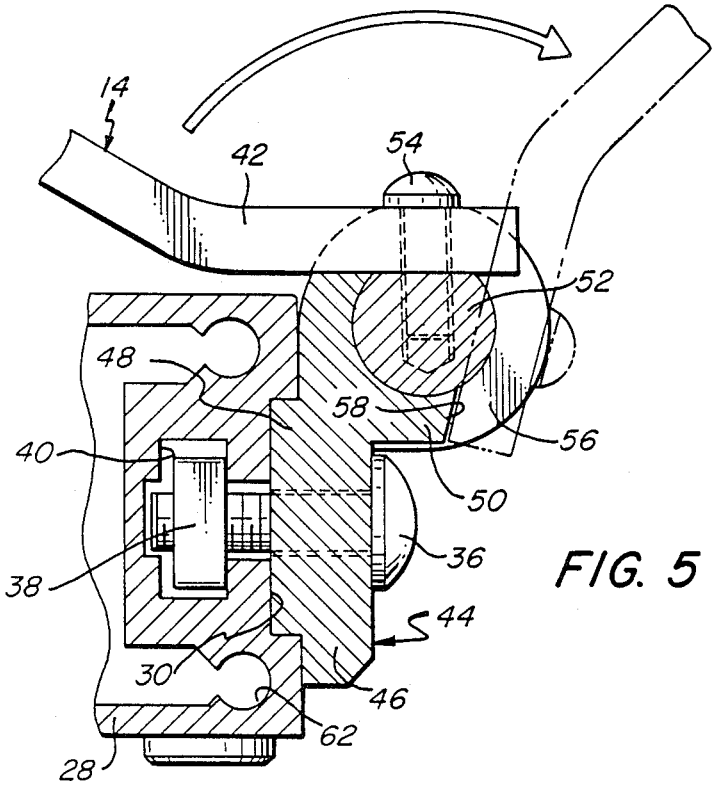
FIG. 5 is a fragmentary sectional view, taken along line 5—5 of FIG. 1 drawn to a greatly enlarged scale, showing the base of the machine and a hingedly attached handle arm, depicted in lowered and elevated (phantom line) positions.

As best seen in FIGS. 5 and 6, the base 10 consists of extruded aluminum sections 26, 28 of similar construction, each having along its right-hand marginal portion (as viewed in the Figures referred to) a longitudinally extending groove 30 and adjacent slot structure 32. The right-hand section 28 of the base has a tongue element 34 extending along its left-hand edge, which is engaged within the groove 30 of the adjacent-section 26. The sections are secured to one another by a bolt 36 and square the structure 32.

The same general arrangement is employed to mount the arms 42 of the handle assembly 14, utilizing a pair of hinges generally designated by the numeral 44. Each hinge includes a bracket portion 46 having a tongue element 48 engaged within the groove 30 of the base section 28, and secured by a nut and bolt fastener. A pair of spaced circular elements 50 journal a short shaft section 52 between them, to which the associated arm 42 is attached by threaded fasteners 54. The circular portions 50 defined by an arcuate channel 56 extending between them, the surface 58 at one end of the channel 56 serving to engage the end of the associated arm 42, to support the elevated handle assembly in a slightly overcenter orientation; the lowered and elevated positions of the assembly are indicated by full and phantom line representations, respectively, in FIG. 5. The sections 26, 28 of the base 10 are further secured by plates 60 attached to its opposite ends (only one of which is shown) using screws inserted into the bore formations 62 formed into the aluminum extrusions, the end plates also contributing to the aesthetics of the machine.

The arms 42 support an elongated tubular handle 64 at their free ends, and a journal block 66 is mounted at an intermediate position, by use of fasteners 68. The opposite ends of a guide rail 70 on a clamping bar, generally designated by the numeral 76, are pivotably received within circular sockets 72 formed into the blocks 66, and the rail is secured therein by suitable bolts 74 inserted axially into each end. The body 112 of the clamping bar 76 is afixed to the rail 70 by a series of screws 78, which are inserted upwardly through apertures 80, and in turn open into a counterbore 82 formed into the underside of the body 112; the rail seats upon a coextensive rib portion 110 of the body. Because the ends of the rail 70 are journaled within the blocks 66, it will be appreciated that the clamping bar 76 is pivotably mounted between the arms 42 of the handle assembly 14, enabling it to adjust automatically to workpieces of varying thicknesses, and to lie flat thereupon.

The trolley of the machine is slidably mounted upon the rail 70 for movement between the arms 42. For that purpose, the body 84 of the head assembly 22 is formed with a channel 86 extending end-to-end therethrough, which is generally rectilinear and enlarged in the center, and opens through the bottom surface 88 along its entire length. Adjacent its opposite ends 90, 92, the body 84 has enlarged portions 96 defining circular seats 98 within the channel 86, each of which seats a plastic (e.g., Delrin) bushing 100. As is best seen in FIGS. 8 and 10, the bushings 100 are of generally circular cross section, with an axially extending gap 108 along the bottom and a countersunk aperture 106 through the top portion and positioned diametrically with respect to the gap. The bushings are interposed between the rail 70 and the body 84 of the head assembly, and each is affixed in position by a set screw 102, which is engaged within a threaded bore 103 of the body and has a conical tip element 104 engaged within the circular aperture 106. Screws 102 serve not only to maintain the bushings 100 in proper orientation on their seats 98, with the slots 108 aligned with the opening of the body channel 86 (through the enlarged portions 96), but they also can be adjusted to take up any clearance that might exist between the body 84, the bushings and the rail 70. It will of course be evident that the slots 108, like the channel opening through the body, are necessary to permit the elongated rib portion 110 on the clamping bar 76 to pass therethrough, so that the trolly can move along the rail 70.

The body 84 is formed with planar surfaces 114, 116 along its opposite sides, surface 114 being perpendicular to the bottom surface 88 and surface 116 forming an acute angle of about 55 degrees therewith; both surfaces will also be substantially parallel to the axis of the rail 70, although it is conventional to deviate slightly (e.g., by about 2°) therefrom on the bevel side so as to avoid "hooking" at the point of initiation of the cut produced. The body 84 has a rectangular bottom surface portion 118 along the bevel side surface 116, which is elevated slightly above the remainder of the surface 88. A strip of pressure-sensitive tape 119, made of a synthetic resinous material such as Teflon, nylon, polyethylene or the like, is affixed over the section 118, to provide a durable and yet readily replaceable, low friction contact surface on the trolley body.

Along the opposite side, an elongated slot 120 is formed into the body 84, which extends longitudinally and parallel to the channel 86. A pivot arm 122 is disposed within the slot 120, and has a hub portion 124 at one end and a circular contact portion 126 at the other. A pivot pin 128 extends through a transverse aperture in the hub portion 124, and has its opposite ends engaged within aligned bore portions 130 formed into the body, thus serving to pivotably mount the arm 122.

Intermediate its ends the arm carries a ball bearing subassembly, generally designated by the numeral 132 and including a contact wheel 134 and an axle 136. As can be seen, the wheel 134 is of sufficient diameter to project beyond the lower edge of the arm 122 and to protrude past the bottom surface 88 of the body when the arm is suitably positioned. This is accomplished by adjustment of the screw 138, which is threadably engaged within a tapped opening 140 of the body 84 with its lower end bearing upon the surface of the contact element 126. A second tapped opening 142 extends upwardly from the slot 120 and has a set screw 144 engaged within it, the purpose of which will be indicated hereinafter.

A blade carrier is pivotably mounted upon both of the side surfaces 114, 116 of the body 84. Since the two carriers are virtually identical, only one of them need be described.

With particular reference to FIGS. 2–4 and 8, it will be seen that the carrier consists of an inner piece and an outer piece, generally designated respectively by the numerals 146 and 148; the pieces are secured in face-to-face contact by four screws 150, which pass through apertures 152 in the outer piece 148 and are engaged within openings 156 of the inner one. Channel portions 160, !62 are formed into the interior faces of the pieces 146, !48, respectively, and they cooperate to provide an enclosure or housing, with a blade magazine channel, when the pieces are assembled, as shown in the several figures.

The inner carrier piece 146 has an enlarged, centrally located aperture 164 formed through it, about which extends an annular shoulder 166, which is recessed from the adjacent surface defining the side of channel portion 160. The aperture 164 receives a shoulder screw 168, which is engaged within the threaded bore 170 extending into the side of the body 84 with its head bearing upon the annular shoulder 166; in this manner the blade carrier is pivotably mounted upon the body, and it will be appreciated that a liner made of low-friction plastic (e.g., nylon) may be interposed against the surfaces 114 and 116 for self-evident reasons. The set screw 144 is tightened against the shaft of the shoulder screw 168, when the latter has been adjusted to the desired extent upon the carrier piece 146, to prevent loosening as a result of pivotal movement of the blade carrier.

Concentric with the aperture 164 is a semi-circular slot 172, within which is disposed is a coil spring 174. One end of the spring is attached to a stud 176, affixed within a hole 178 extending into the surface 114, 116, and the other end is hooked upon the protruding tip of a set screw 180, which is engaged within an oblique tapped bore 182 formed into the inner carrier piece 146.

Figure 4:
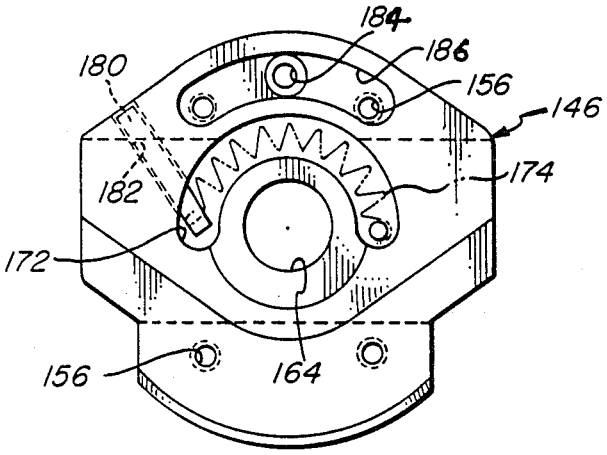
FIG. 4 is a plan view of the exterior surface of the inner blade carrier piece showing, in phantom line, the attached retraction coil spring.

An aperture 184 is centrally disposed in the piece 146 near its upper edge and, as can be seen in FIG. 4, it opens into an arcuate groove 186 formed into its exterior face. The outer carrier piece 148 has a rectangular window 188 formed through it, and it has a small block-like element 190 protruding at a central position intermediate the edges and near one end of its channel portion 162. The functions of these features will be discussed more fully below.

The carrier also includes a finger rest, or operating lever 192, and an operating knob 194. The lever 192 is retained in place between the pieces 146, 148 by the screws 150, which pass through aligned apertures 196 therein, and the knob 194 has a threaded shaft by which it is mounted within the tapped aperture 198 in the outer piece 148. It will be noted that the lever 192 has a laterally extending slot 202 formed through its blade portion 200, which extends within a circular recess 204, and that diametrical groove portions 206 extend at a right-angle to it. Although not visible, it is important to note that the structure associated with the lateral slot 202 is the same on both sides of the blade portion 200.

One difference between the carrier employed on the two opposite sides of the body 84 relates to the detent arrangement used to maintain the carrier on the perpendicular surface 114 in its lowered, operative position. As can best be seen in FIG. 3, the detent takes the form of a cylindrical component or pin 208, which is slidably seated within the recess 210 of a cup that is seated within an opening formed into the surface 114, and has a coil spring 212 inserted behind it to exert an outward biasing effect. A lock-out pin 214 has its shaft extending through an aperture 216 of the outer carrier piece 148 and the aperture 184 of the inner piece 146, with which it is aligned, and also through the slot 202 of the operating lever blade 200. A cross-pin 218 extends through the transverse hole 220 in the shaft of the pin 214, and is dimensioned to pass through the slot 202 and to seat within the diametrical groove portions 206.

When the cross-pin 218 is aligned with the slot 206, the tip of the lock-out pin 214 will be free to shift out of the aperture 184 of the inner piece 146 (but not to pass through the aperture 216), permitting the detent pin 208 to enter it and thereby to lock the blade carrier against relative pivoting about the shoulder screw 168. Because of the offset of the recess 210 (from the top-to-bottom axis of the body, taken through the threaded bore 170), it will be appreciated that the detent pin will maintain the blade carrier in a position of rotation, against the force of the retraction spring 174, in the operative position of the cutting blade.

Release of the blade carrier is effected simply by pushing the lock-out pin inwardly to unseat the pin 208 from the aperture 184, thus allowing the carrier to return under the influence of the spring 174. If it is desired to prevent locking of the carrier in its rotated postion, it is simply a matter of depressing the lock-out pin 214 and rotating it through an angle of 90 degrees (the pin having a knurled head to facilitate doing so). The transverse pin 218 will then seat within the groove portions 206 (on the side of the blade 200 not visible in FIG. 3), causing the tip of the shaft of pin 214 to project into the aperture 184 a distance sufficient to prevent effective entry of the detent pin 208. It will be noted that the fixed stud 176 projecting from the surface 114 of the body 84 lies within the semi-circular slot 172 of the inner piece 146. Accordingly, when the detent is not employed to fix the carrier in its rotated position, the stud 176 serves to accurately and reproducably establish the limit of rotation by abutting against the surface at the end of the slot 172.

Although the blade carrier on the opposite (bevel) side of the body 84 does not include the detent and lock-out pin arrangement (because the bevel cuts are normally considerably shorter than the perpendicular ones, which are used for example to subdivide full sheets of mat board), it does have a stud 176 upon which one nd of the return spring 174 employed therewith is attached. In this instance, the stud 176 serves the same limit function as in the case of the carrier on the perpendicular side of the body, as seen in FIG. 8 of the drawings. It might also be noted that a bore 142', similar to the bore 142 on the opposite side but of greater length, is provided for set screw 144', which is also elongated to compensate for the absence of the slot 120 on the bevel side.

Figure 3:
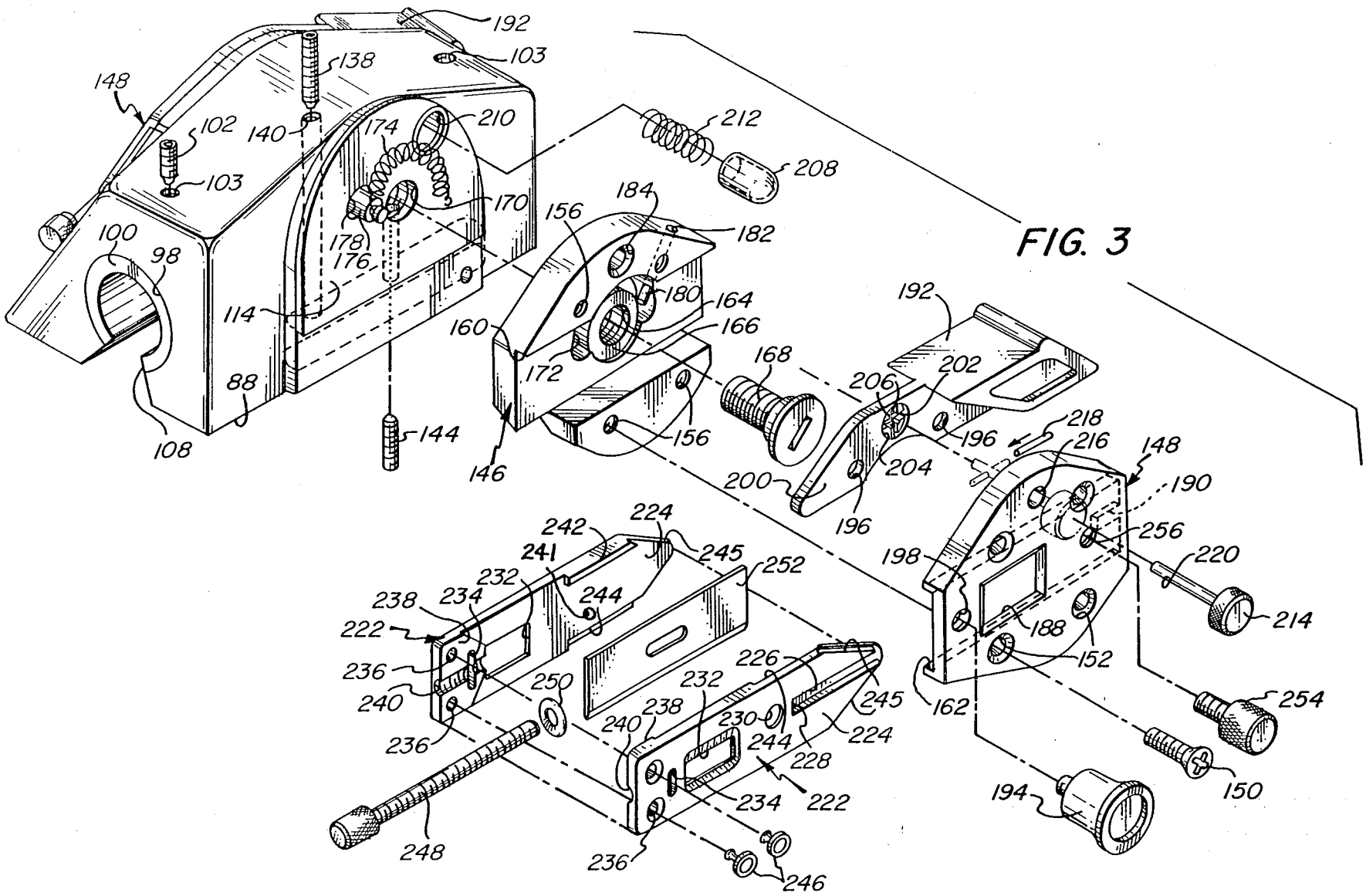
FIG. 3 is an exploded perspective view of the trolley used in the machine and the blade-holding magazine, drawn to the scale of FIG. 2.

Each of the two blade carriers serves to mount a blade magazine, which in turn holds the cutting blade. As best seen in FIG. 3, the magazine consists of a pair of identical, generally rectangular plates, each generally designated by the numeral 222 and having a pointed forward or leading end portion 224. A rectilinear groove 226 extends longitudinally from the tip of each plate, midway between the edges, and terminates in a wall element 228. A shallow circular recess 230 is formed into the surface of the plate adjacent the end of the slot, and a rectangular window 230 is disposed rearwardly of recess 230. As will be noted, a measuring scale is embossed upon the upper and lower beveled edges defining the window 232, and conveniently the graduation marks may denote 1/32-inch intervals. A transversely extending slot 234 is formed through the plate next to the window 232, and a pair of apertures 236 are provided adjacent is trailing edge. The inside surface of the plate is substantially planar, except that it has a slightly elevated rearward section 238 through which a threaded, semicircular channel portion 240 extends longitudinally, traversing the slot 234; it may also have a shallow blind hole 241 to receive a plastic ball-like element (not shown). A narrow ledge 242 projects inwardly along one margin at the forward portion of the plate, and a correspondingly dimensioned (although slightly narrower) and configured recess 244 extends along the opposite margin.

The magazine itself is produced simply by securing two of the plates 222 together in face-to-face contact, using a pair of rivets 246 extending through the aligned apertures 236. In assembly, the ledge element 242 of one plate is seated within the corresponding recess 244 of the other, and the channel portions 240 cooperatively define a threaded passageway, in which the adjustment screw 248 is engaged. The screw passes through a rubber 0-ring 250, which is retained between the two aligned transverse slots 234; the 0-ring frictionally engages the threaded shaft of the adjustment screw 248, and inhibits turning (and hence loss of adjustment) inadvertently or due to vibrational or like forces.

Because of the added thickness contributed by the surface sections 238, and the corresponding width of the marginal elements 242, the paired plates define a thin cavity of planar configuration in the area in front of the elevated sections. The spacing of the walls is sufficient to permit the cutting blade 252 to be freely inserted between the plates, from the leading end of the magazine; however, plastic ball-like elements may be seated in the holes 241 to create tension on the blade, for an optimal fit, and the adjustment screw 248 may serve to limit the depth of insertion. It will be appreciated that the corners of the blade 252 will project beyond the oblique edges 245 of the plates, and that the extent of projection can be altered with the screw 248, using the trailing edge of the blade 252, in registry with the graduated scales along the edges of the windows 232, to achieve a measured adjustment, if so desired.

The magazine is mounted into the carrier by inserting it, pointed end first, into the channel defined by the portions 160, 162 in the pieces 146, 148. As the magazine is slid into the channel, the small stop block 190 on the outer carrier piece 148 enters the longitudinal slot 226, ultimately bottoming upon the end surface 228 thereof; in this manner, the depth of magazine insertion is positively limited, so as to permit precise and facile repositioning. When the magazine has been inserted fully, the locking screw 254, which is threadably engaged within the aperture 256 of the piece 148, is tightened to cause the end of its shaft to enter the circular recess 230 formed into the surface of the underlying magazine plate 222. This serves to not only lock the magazine in position, but also the clamping force is transmitted to the blade 252 within the cavity, through the wall of the magazine plate (which is sufficiently deflectable for that purpose), to affix it in position as well.

With particular reference now to FIG. 7, the lower production stop 18 consists of a body 258 having a longitudinally extending channel 260 of circular cross-section formed into it, which opens along the bottom of the body through a parallel-sided slot 262; the rail 70 and the longitudinal rib portion 110 of the clamping bar 112, respectively, seat therein, rendering the stop 18 slidable along the rail. A compound slot 264 extends obliquely from the underside of the body 258 to define a shoulder portion 266 which is connected to the remainder of the body through a relatively thin neck section 268. A threaded aperture 270 extends through the adjacent outer body portion 272 and normal to the surface of the shoulder 266, within which is engaged a clamping screw 273. Tightening of the screw 273 against the shoulder portion 266 will deflect it inwardly about the neck section 268, to grip the rail 70 and the rib portion 110, thereby enabling the stop 18 to be firmly locked in any desired position therealong.

Figure 2:
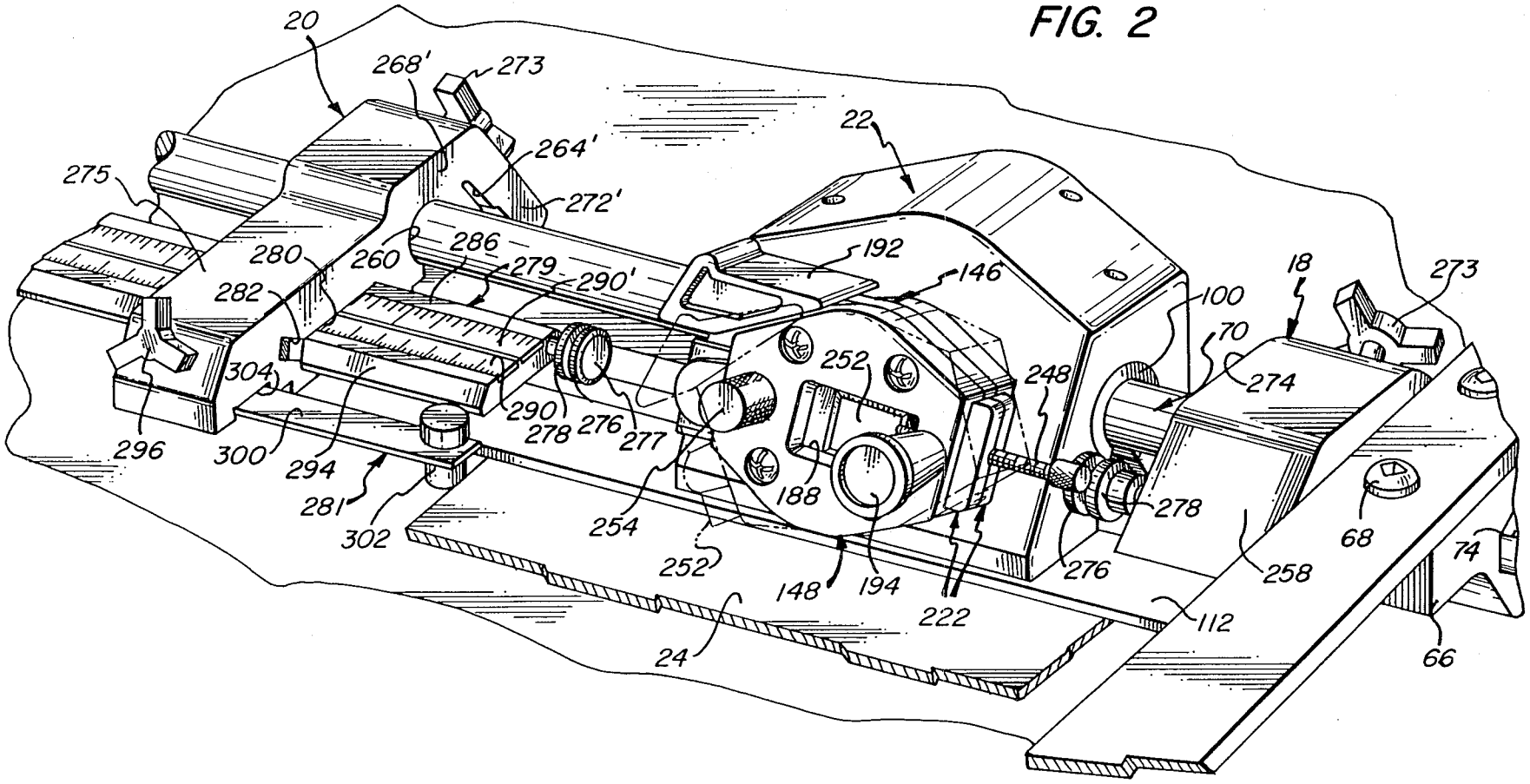
FIG. 2 is a fragmentary, opposite-side perspective view of the machine of FIG. 1, drawn to a greatly enlarged scale and showing one of the blade carriers in its raised position and (in phantom line) its lowered, operative position.

As is best seen in FIG. 2, an adjustable stop subassembly extends from the upper or outer face 274 of the body 258. It consists of a screw 276 having a knurled head, on which a cushioning pad (not visible) may be provided, and having its threaded shaft engaged in a suitable bore (also not visible) extending into the stop body. A knurled nut 278 is threadably engaged on the shaft of the screw 276 for locking it in any position relative to the body. The stop element 276 serves of course to limit travel of the head assembly 22 in the downward, or inward (toward the user), direction.

The details of the upper production stop 20 are seen most clearly in FIG. 6, and it has clamping features that are substantially the same as those on the lower production stop 18; to that extent, therefore, they are designated by the same numbers, some of which are marked with a prime. The arm portion 275 of the body 258,, which extends laterally to the opposite side of the clamping arrangement, is considerably different however from the corresponding portion of the lower stop, and is constructed to support a sliding rule and a locating lug subassembly, generally designated respectively by the numerals 279 and 281. To support the rule, the arm portion 275 has a channel 280 transversing its underside, along one side of which extends a communicating parallel slot 282 and into which opens, in turn, a threaded, oblique bore 284. The rule 279 consists of an elongated, straight-edged body 286, into the upper surface of which is formed a pair of parallel, longitudinally extending grooves 288; a rule strip 290, 290' is affixed within each slot 288, one being marked in metric and the other being marked in English units. A force-distributing contact shoe 292 is seated within the lateral slot 282, and is disposed to engage the beveled edge surface 294 on the rule body 286 The end of the clamping screw 296 bears in turn upon one side of the shoe 292 (which is indented to receive it), and it is tightened to secure the rule 279 in any selected position; the amount of extension is of course indicated by registration of a graduation mark on one of the scales 290, 290, with the overlying straight edge of the lateral arm portion 275.

A threaded bore 298 extends longitudinally into the forward end of the rule body 286, and engages the shaft of a stop element screw 276, which is the same as corresponding component on the lower production stop 18; here, however, the resilient contact pad 277 on the head of the screw 276 is visible. The upper production stop 20 serves of course to limit travel of the trolley in the upper, or outward, direction.

The locating lug subassembly 281 consists of a spring 300 in strip form, having a locating lug 302 affixed adjacent one end The opposite end is seated within a groove 304 formed into the underside of the arm portion 275 of the upper stop 20, adjacent its outer end, and is secured in place by screws 306.

Figure 12:
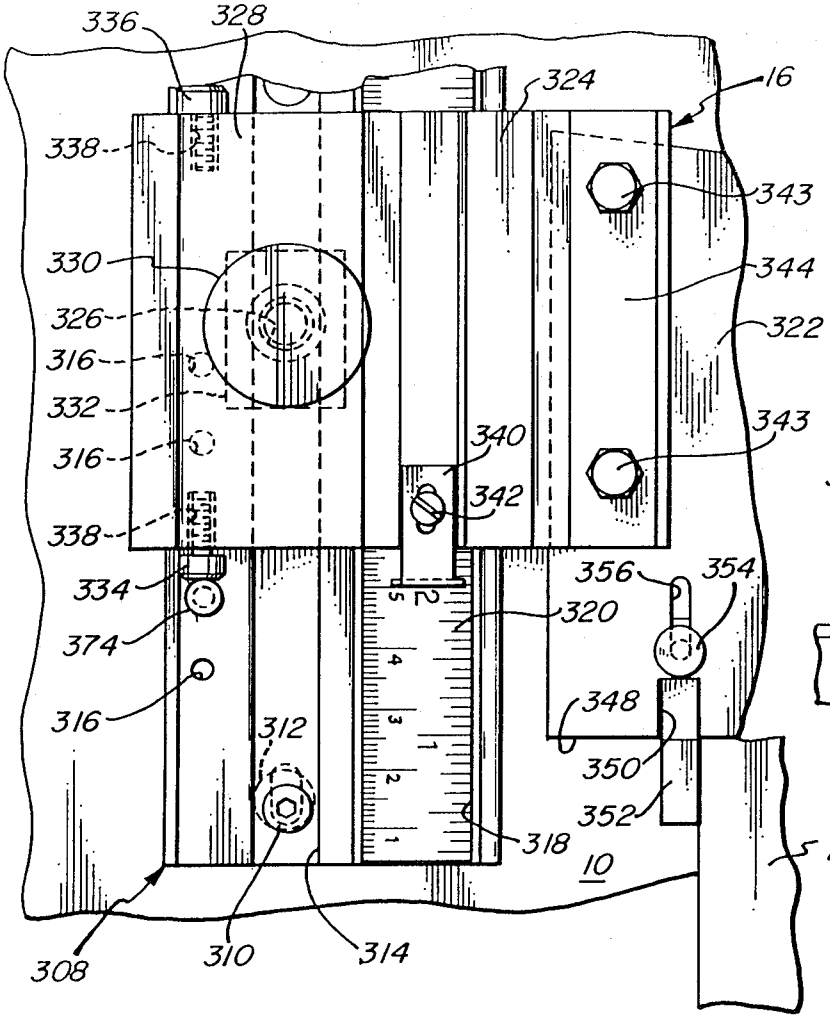
FIG. 12 is a fragmentary plan view of the left squaring guide assembly and associated parts of the machine, also showing a section of the piece of mat board engaged thereby.
Figure 13:
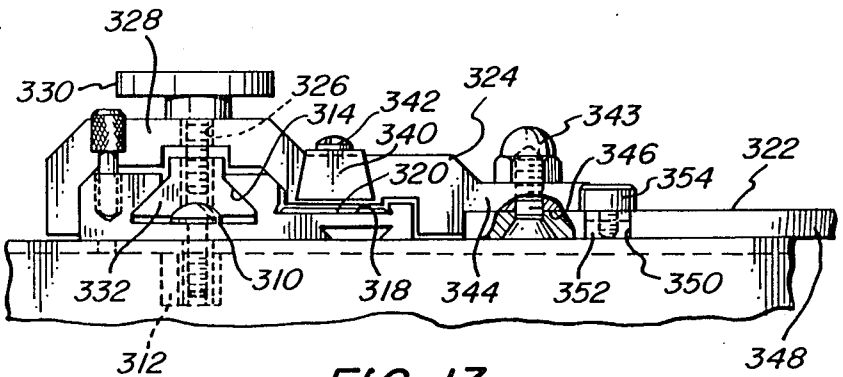
FIG. 13 is an end view of the assembly of FIG. 12 viewed from the bottom thereof and having sections broken away to show internal structure.

As is shown in greatest detail in FIGS. 12 and 13, the left squaring guide assembly consists of the slider subassembly, generally designated by the numeral 16, and the rectilinear guide bar, generally designated by the numeral 308, upon which it is mounted. The bar 308 is attached to the base 10 of the machine by suitable means, including a bolt 310 and an eccentric element 312, which permit fine adjustment, to achieve absolute perpendicularity with respect to the rail 70 and the clamping bar 76. An inverted, V-shaped slot 314 runs along the length of the bar 308, and a series of equidistantly spaced apertures 316 are provided along a parallel axis to one side; a shallow channel 318 extends along a parallel axis to the opposite side and a rule component 320, having both metric and English system units thereon, is affixed therewithin.

The slider subassembly consists of the truncated triangular edge guide plate 322 and the slider body 324, the latter having an arched portion which extends about the bar 308 and engages it in a close-fitting but freely slidable relationship. A threaded aperture 326 extends through the uppermost wall portion 328 of the body 324, to receive the shaft of a clamping screw 330, the tip of which is engaged within the threaded bore of a clamping block or key 332, which is also of generally V-shaped configuration to conform closely to the cross-section of the slot 314. As will be appreciated, tightening the screw 330 will draw the block 332 into clamping engagement with the inclined surfaces defining the slot 314, thereby locking the slider body 324 in any desired position along its length A pair of stop screws 334, 336 project laterally from the opposite sides of the body 324, and they are engaged within threaded bores 338 to permit variation of the amount of their projection. An indicator tab 340 is attached to the slider body directly over the scale 320, to cooperate therewith for locating the position of the slider subassembly along the bar, and it is secured for limited adjustment of its position by a screw 342.

The guide plate 322 is secured by nut and blot fasteners 343 to the outwardly projecting flange portion 344 of the slider body, which is formed with an underlying shoulder 346 for squarely seating the plate. As will be appreciated, the plate 322 has a straight edge 348 which will extend in a precisely parallel relationship to the guide rail 70 when the mounting bar 308 of the assembly is affixed in proper relationship. The edge 348 of the plate is slotted at 350 adjacent its base, and a stop piece 352 is slidably engaged thereinwithin. A small clamping screw 354 is engaged in one end of the stop piece 352 and extends through a slot 356 in the plate 322. This arrangement permits extension of the stop piece beyond the edge 348, and retraction to a flush position, using the screw 354 to affix it where desired.

The outside sizing subassembly 12 also includes a rectilinear bar 358 which is attached at one end to the machine base, and is similar to the bar 308 of the squaring guide slot but considerably longer. It too has an inverted V-shaped slot 360 extending longitudinally along its entire length, with an adjacent parallel scale 362, and it slidably mounts a slider, generally designated by the numeral 364 and including a clamping block/-screw arrangement 366 as well as means for indicating the position of the slider (with reference to the scale 362) therealong. These features are similar to those employed on the slider subassembly 16, and need not therefore be described in further detail. A mat-supporting shelf piece 374 extends along the upper edge of the bar 358. Extending between the outer end of the bar 358 and the edge of the base 10 is a diagonal brace 368, which is fastened at those locations by an eccentric fastener 370 and by a clamping member 372, respectively. The fastener 370 is utilized for fine adjustment of perpendicularity of the bar 358 with respect to the rail 70, and the clamping member 372 is employed for rougher variation.

Although the manner in which the machine is employed will be evident to those skilled in the art, some description of production operation may nevertheless be beneficial. Preliminary outside sizing of the mat board sheet may be accomplished by any suitable means, as with a guillotine cutter; however, the subassembly 12 of the machine affords a convenient option. In use, the slider 364 is simply positioned to corespond to the desired external dimension, utilizing the scale 362. The clamping bar 112 is lifted away from the surface of the base 10 by elevation of the handle 64, and the sheet of mat board is placed thereupon and brought into position against the supporting shelf 358 and the inner edge of the slider 364. Next, the head assembly 22 is moved outwardly along the rail 70 to a point beyond the upper edge of the board, following which the carrier on the perpendicular face 114 is pivoted to its operative position and run along the sheet, the underlying groove 27 in the base section 28 serving to receive the tip of the blade 252, as necessary. For long cuts, and particularly where difficulty might be encountered in maintaining the pivoted condition of the carrier while simultaneously sliding the trolley along the rail in the cutting operation, the detent pin 208 may advantageously be utilized The piece 24 of board produced will then be positioned under the clamping bar 112, with one edge against the edge 348 of the plate 322 of the left squaring guide and with the adjacent edge of the board resting upon the extended stop piece 352, the slider subassembly 16 first having been positioned to create the desired margin width; generally, the longer cuts will be made initially.

Lower production stop 18 is affixed in suitable position to control the travel of the trolley so as to terminate the cut at the desired point near the lower edge of the piece 24, and the point of cut initiation is established by the position of upper production stop 20. The latter is determined by adjustment of the rule 279 to extend the desired distance beyond the lateral arm portion 275, as indicated by the appropriate scale 290, 290, Having done so, the stop 20 is then moved along the rail 70, with the locating lug 302 depressed by finger pressure, until it contacts the upper edge of the piece 24; at that point, the stop is clamped in position and the lug 302 is allowed to spring upwardly, out of the way. The stop elements 276 will limit travel of the trolley to produce the desired length and position of the cuts, each of which is made of course with the carrier on the beveled surface 116 of the body 84 pivoted to operative position as the trolley is moved inwardly along the rail 70, and with the mat board face down on the base; the base section 28 has a groove 29 formed into its surface to provide clearance for the blade. Cutting operations are repeated (with adjustments to the upper production stop 20 being made as necessary) until the sight opening is completly severed from the piece 24.

Although positioning of the left squaring guide assembly can readily be accomplished by use of the scale 320 and indicator tab 340, for production purposes it will often prove more facile to employ the removable pin 374, in cooperation with the apertures 316 along the edge of the bar 308, which are disposed at intervals that represent typical margin widths (e.g., half-inch spacing). By placing the pin 374 in a suitable one of the apertures 316, and by sliding the squaring guide assembly to be bring the stop screw 334 into contact with the pin, the edge 348 of the guide plate 322 can quickly and reliably be positioned to produce the desired margin. In those instances in which the interval between the apertures 316 is too great to provide a desired margin width, a spacer (e.g., a cylinder of suitable diameter) can be placed between the pin and the stop screw 334 to achieve the desired result; this technique may be particularly convenient when a double-mat assembly is being produced.

In certain instances, moreover, it is necessary to operate very close to the edge of the clamping bar, such as in the production of V-cuts, which are commonly used to achieve a certain border effect. The machine of the invention can be employed conveniently and to good effect for that purpose, by inserting the pin 374 into an aperture 316 which is disposed to the outer side of the slider after the guide plate has been moved to its approximate desired position (the automatic elevation of the locating lug 302 facilitating doing so), and by bringing the screw 336 into contact with it to locate the final position.

As noted above, a particularly advantageous feature of the present invention resides in the provision of the blade-holding magazines which are readily interchangeable and yet securely fastened in the carriers on the opposite sides of the trolley. One advantage is that they enable the amount of blade extension from one magazine to be left undisturbed, and simply replaced with a different magazine from which blade projection is greater or lesser if a change is desired. Similarly, for certain operations blades of different thicknesses are most effective, and again changes can be made by replacement, without need for readjustment.

Another advantage stems from the fact that, as has been noted previously, insertion of the blade into the magazine is achieved simply by sliding it in, from the leading end. Because this can be done with little force and with the magazine removed from the carrier, the risk of injury to the user is minimized.

The trolley described is an especially important feature, since it affords a high degree of cutting precision, coupled with a very free and smooth sliding action. These results are achieved by the cooperative effects of the bushings 100 disposed within the cutting head, the ball bearing wheel subassembly 132 on the pivot arm 122, and the strip of low friction synthetic resinous material 119 on the surface portion 118; these cooperate with stainless steel glide strips 125, which are bonded to the surface of the clamping bar 112 and extend along the length thereof, on opposite sides of the rail 70 and parallel to it, to produce a most desirable gliding movement. The strips 125 may be about 10 mils in thickness, made of stainless steel having a Rockwell C hardness value of 40–45, and backed with a pressure sensitive adhesive. As indicated in FIG. 6, strips 127 of measuring rule structure may extend parallel to the glide strips 125, for at least a portion of the length of the clamping bar 76.

In a machine of this kind, it is important that the cutting blade on the bevel side be brought to a position closely adjacent the edge of the clamping bar, and this is readily achieved by use of the adjustable wheel mechanism and the plastic strip; the fit between the cutting head 22 and the rail 70 is ensured by the bushings 100, independently of the wheel sub-assembly adjustment, as is most desirable.

Two or more pads 376 may be secured along the edge of the clamping bar 112 corresponding to the perpendicular face of the carrier head, to bias the opposite edge downwardly and thereby create an enhanced clamping effect therealong, which also contributes to the precision by which the bevel cut can be made. Pads or cushions will normally also be provided on the bottom of the base, to prevent slippage of the machine during use, and bumpers may be affixed to certain parts (such as the lower bracket 66 by which the rail 70 is supported) to absorb the shock of impact from the trolley at the end of the cutting stroke.

Figure 14:
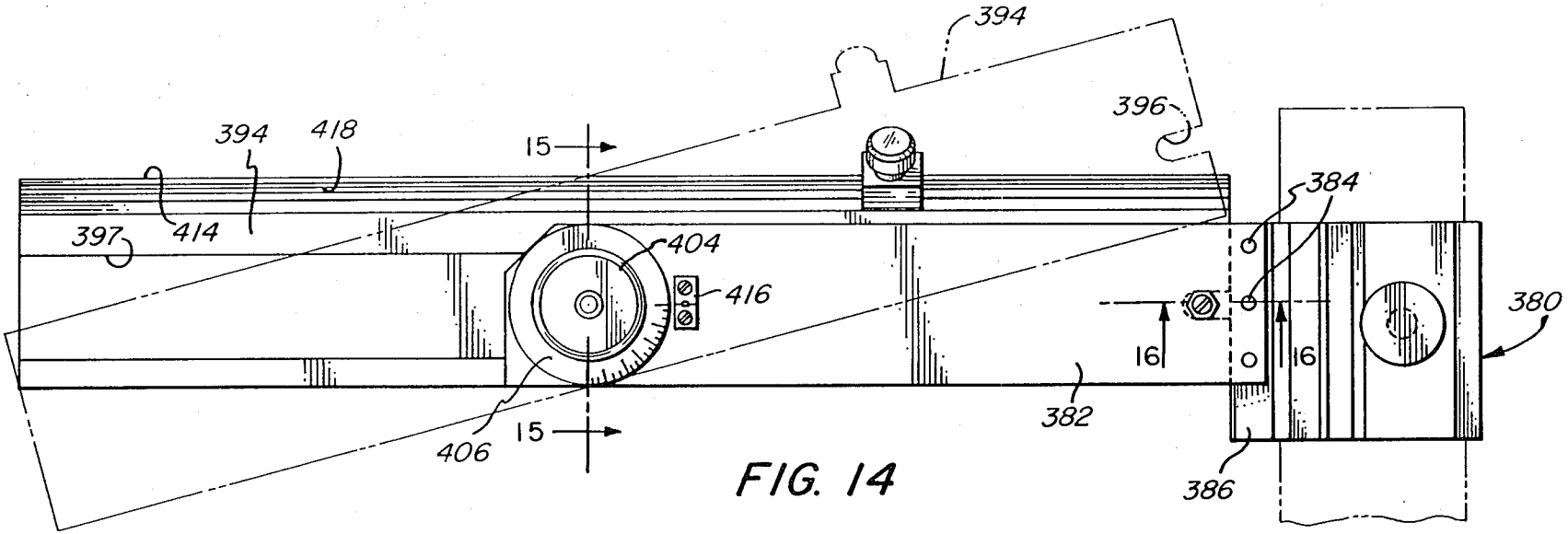
FIG. 14 is a plan view of a protractor guide assembly that can be substituted for the left squaring guide assembly, with an alternative orientation of the guide bar, and the mounting parts of the machine, shown phantom line.
Figure 16:
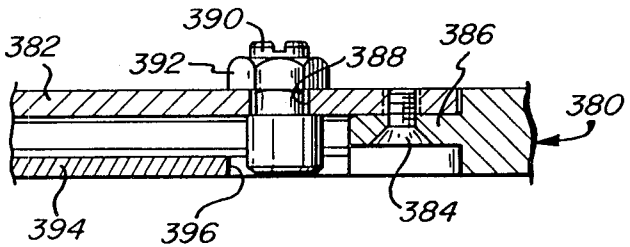
FIG. 16 is a fragmentary sectional view, taken along line 16—16 of FIG. 14 and drawn to an enlarged scale.
Figure 15:
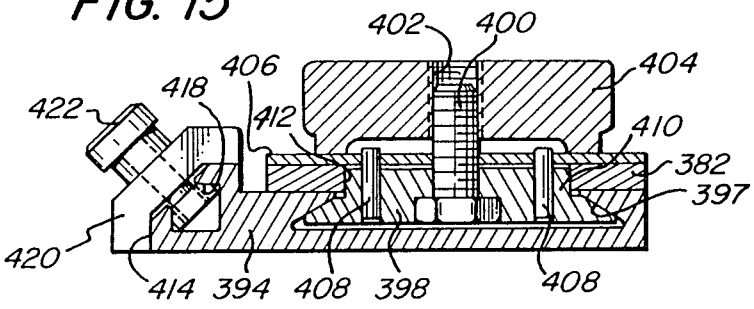
FIG. 15 is a sectional view of the protractor assembly, taken along line 15—15 of FIG. 14.

Turning finally to FIGS. 14–16 of the drawings, therein illustrated is a protractor-style squaring guide assembly that can optionally be substituted for the guide assembly illustrated in FIGS. 12 and 13. The instant assembly employs a slide member, generally designated by the numeral 380, which is substantially the same as that of those Figures, and need not therefore be described in great detail.

In place of the truncated triangular plate 332 of the prior embodiment, a generally rectangular beam 382 is employed, which is secured at one end to the body of the slide member 380 by screws 384, the slide body being provided with a flange portion 386 for that purpose. Adjacent the point of attachment, the beam 382 has an aperture 388, through which is received a locating lug member, which includes an eccentric lug element 390 and a locking nut 392. Disposed beneath the beam 382 is a rectangular edge guide member 394, which has a slot 396 extending into one end, and an upwardly-opening and outwardly tapered groove 397 extending longitudinally therealong.

Seated within the channel 397 is a clamping piece 398, from which extends upwardly a captured bolt 400, the threaded end portion of which is engaged within the threaded bore 402 of a tightening knob 404. The knob in turn bears upon a circular scale plate 406, which is disposed upon the upper surface of the beam 382 and is staked to the clamping piece 398 by a pair of dowel pins 408. The clamping piece 398 has a circular hub portion 410 which extends out of the channel 397 in the guide bar 394, and the beam 382 has a corresponding circular aperture 412 within which the hub portion 410 is rotatably engaged.

Consequently, with the knob 404 in a loosened condition the guide bar 394 can be rotated relative to the beam 382, to permit its straight edge 414 to be disposed within a range of angular orientations with respect to the beam 382, and hence with respect to the guide rail 70. As will be noted, the scale plate 406 has one quadrant which is graduated in degrees, enabling it to cooperate with the indicator 416, secured to the upper surface of the beam 382, for disposition of the edge 414 at any desired angle of 0° to 90°, relative to the beam. When engaged within the slot 396, the lug element 390 serves to lock the guide bar 394 in a position parallel to the rail 70; it is released by sliding the bar 394 longitudinally, to permit utilization of the protractor feature.

Finally, it will be noted that the guide bar 394 has a slot 418 extending along the rectilinar edge 414 throughout its entire length. A stop piece 420 is configured to slide along the surfaces defining the slot 418, and an appropriate clamping nut and bolt arrangement 422 is mounted thereon to permit the stop piece to be fixed in any position therealong. As will be appreciated, the stop piece serves to engage one corner of a mat board disposed against the edge 414, in the same manner as the stop piece 352 provided on the panel 322 of the guide assembly previously described.

Thus, it can be seen that the present invention provides a novel mat cutting machine that is capable of producing both perpendicular and also bevel cuts in mat board, with a high degree of accuracy and without substantial deviation from strict rectilinearity. The cutting head of the machine is rigidly supported, and yet it affords smooth, comfortable and facile operation, with ready adjustability to achieve ideal positioning of the blade. The mat board can readily be positioned, quickly and accurately in the machine, so as to provide high volume production capability, and the machine is relatively economical and facile to manufacture and is attractive from an asthetic standpoint.

Having thus described the invention, what is claim is:

1. In a mat cutting maching, the combination comprising:

a base;

a handle assembly pivotably mounted upon said base for movement between a position overlying the upper, mat-supporting surface of said base, and a position displaced therefrom;

a clamping bar assembly pivotably mounted by said handle assembly and including an elongated clamping bar and substantially coextensive guide rail, said clamping bar having a substantially planar bottom surface and being adapted to rest with said bottom surface substantially upon said upper surface of said base with said handle assembly in said overlying position thereof, and said guide rail being affixed to the upper side of said clamping bar and adapted to slidably mount a cutting head assembly for movement therealong; and a stop assembly slidably mounted upon said rail for movement therealong, said stop assembly comprising a body having a clamping portion slidably mounted upon said rail and including clamping means for securing said stop assembly in selected positions therealong, and a supporting portion extending laterally from said clamping portion, said supporting portion having an elongated rule body slidably mounted thereon for extension along an axis parallel to the axis of said rail, with cooperating means thereon for affixing said rule body in selected positions of extension, said rule body in turn having a stop element mounted thereon for adjustable extension therefrom along said parallel axis, said supporting portion also having a locating subassembly mounted thereon and including a spring element extending from said supporting portion along another axis generally parallel to said rail axis and in the direction of extension of said stop element, and a locating element adjacent a free end of said spring element, said locating element normally being disposed above said upper surface of said base with said handle assembly in said overlying position thereof, and being resiliently deflectable on said spring element into contact therewith.

2. The combination of claim 1 wherein said spring element is in strip form, and said locating element is a lug extending downwardly from adjacent the outer end thereof.

3. The combination of claim 1 wherein said clamping portion of said stop assembly body comprises an inner, resiliently deflectable component and an outer, relatively rigid component, said inner component having a surface element in contact with said rail, and said outer component mounting a clamping screw having one end portion in contact with said inner component to permit the application of deflective force thereon by adjustment of said clamping screw, such adjustment serving to bring said surface element of said inner component into clamping engagement with said rail for affixing said stop assembly in selected positions therealong.

4. The combination of claim 1 additionally including a squaring guide assembly and an elongated, rectilinear guide bar affixed on said base upper surface in position to lie to one side of said clamping bar assembly, and extending perpendicular to said rail axis, when said handle assembly is in said overlying position thereof, said squaring guide assembly including a slide subassembly comprising a body slidably mounted upon said guide bar for movement to each of several positions spaced at different distances from said clamping bar assembly, and having inner and outer opposite lateral edge portions each with a step element thereon, said combination additionally including positioning means affixable at various points along said guide bar for alternative contact, at least at one of said points, with both of said stop elements on said slider body, to thereby locate said slider subassembly at each of said several positions relative to said clamping bar assembly.

5. The combination of claim 4 wherein said guide bar has a series of apertures therein at spaced points along the longitudinal axis thereof, and wherein a pin engageable in said apertures cooperates therewith to provide said positioning means.

* * * * *